US010041717B2

(12) United States Patent
Maxwell et al.

(10) Patent No.: US 10,041,717 B2
(45) Date of Patent: Aug. 7, 2018

(54) AIR TOWER IMPROVEMENT FOR A REFRIGERATOR

(71) Applicant: Electrolux Home Products, Inc., Charlotte, NC (US)

(72) Inventors: Abanni Maxwell, Anderson, SC (US); Rodrigo Marge Pagnozzi, Curitiba (BR); Jorge Luis Nino Garza, Anderson, SC (US); Danny Ray Parker, Jr., Anderson, SC (US); John Thomas Campbell, III, Anderson, SC (US); Salvador Ponce de Leon Dominguez, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/335,727

(22) Filed: Oct. 27, 2016

(65) Prior Publication Data

US 2018/0120016 A1 May 3, 2018

(51) Int. Cl.
*F25D 17/04* (2006.01)
*F25D 17/06* (2006.01)

(52) U.S. Cl.
CPC ..... *F25D 17/045* (2013.01); *F25D 17/065* (2013.01); *F25D 2317/067* (2013.01)

(58) Field of Classification Search
CPC ..... F25D 17/062; F25D 17/065; F25D 17/08; F25D 2317/066
USPC ..... 62/408
See application file for complete search history.

(56) References Cited

U.S. PATENT DOCUMENTS

| | | | | |
|---|---|---|---|---|
| 4,920,765 | A | 5/1990 | McCauley | |
| 5,369,963 | A | 12/1994 | Pickles | |
| 7,231,780 | B2 | 6/2007 | Park | |
| 7,299,651 | B2 | 11/2007 | Oh | |
| 7,559,121 | B2 | 7/2009 | Perrotto | |
| 7,866,182 | B2 | 1/2011 | Lim | |
| 8,806,885 | B2 | 8/2014 | Bae et al. | |
| 2002/0139950 | A1* | 10/2002 | Lanz | F16K 11/085 251/129.11 |
| 2008/0236187 | A1* | 10/2008 | Kim | F25C 1/04 62/344 |
| 2010/0125365 | A1 | 5/2010 | Ahn et al. | |
| 2011/0011106 | A1 | 1/2011 | Ahn et al. | |
| 2011/0011118 | A1 | 1/2011 | Cho et al. | |
| 2012/0036879 | A1* | 2/2012 | Candeo | F25D 17/045 62/187 |
| 2012/0096887 | A1 | 4/2012 | Cho et al. | |
| 2013/0042641 | A1* | 2/2013 | Ryu | F25D 17/065 62/228.1 |

* cited by examiner

*Primary Examiner* — Steve Tanenbaum
(74) *Attorney, Agent, or Firm* — Pearne & Gordon LLP

(57) ABSTRACT

An air tower assembly includes an outer housing, a duct with a damper opening, a damper configured to control a flow of air from a freezer compartment to a fresh food compartment, and at least partially transparent rear cover sheet attached to a rear of the outer housing that contains the duct and the damper within the air tower assembly. The rear cover sheet may be transparent or may have a clear or semi-opaque surface configured to allow visual confirmation of the damper during assembly, operation, and service. An air passageway is provided between the freezer compartment and the fresh food compartment to allow air to flow from the fresh food compartment to the freezer compartment.

20 Claims, 13 Drawing Sheets

AIR TOWER IMPROVEMENT FOR A REFRIGERATOR

FIELD OF INVENTION

The following description relates generally to a refrigeration appliance, and more specifically to an air tower assembly mounted to a liner in a compartment of the refrigerator.

BACKGROUND OF INVENTION

Refrigeration appliances, such as domestic refrigerators, are often provided with an air distribution system, such as an air duct or an air tower assembly, for the purpose of directing and dispersing cold air into one of the freezer and fresh food compartments. Often, the cold air is directed from the freezer compartment to the fresh food compartment of the refrigerator. In bottom-mount refrigerators, the air tower extends vertically between the lower freezer compartment and the upper fresh food compartment to deliver cold air from an evaporator assembly located in the freezer compartment into the fresh food compartment. The air tower may be mounted to the liner included in the fresh food compartment of the refrigerator, and may be partially located in the foam insulation. The air tower is secured to the rear wall of the fresh food compartment, and mates with an opening in the lower wall of the fresh food liner directly above the freezer evaporator. Cold air is then discharged into the fresh food compartment from one or more openings in the air tower.

Air towers generally include various sequentially assembled components. As a result, air towers suffer from air leakage through gaps that may exist between these components. For example, one problem area where such gap may exist between the front-access panel service door for the damper that typically covers the air tower housing. The air leakage through this gap, and other existing gaps, causes insufficient cold air flow through the air tower, making it difficult to circulate the cool air near the top, which undesirably increases the temperature in the top compartment. Therefore, it is desirable to provide an air tower that promotes improved cool air circulation within the fresh food compartment.

SUMMARY

The present invention provides an air tower assembly mounted to a liner in the fresh food compartment of a refrigerator.

In one general aspect, an air tower assembly may include an outer housing, a duct with a damper opening, a damper configured to control a flow of air from a freezer compartment to a fresh food compartment, and at least a partially transparent rear cover sheet attached to a rear of the outer housing that contains the duct and the damper within the air tower assembly.

In another general aspect, the rear cover sheet may be transparent.

In another general aspect, the rear cover sheet may be integrally molded as a single monolithic unit that covers an entire duct.

In another general aspect, the rear cover sheet may have a clear surface configured to allow visual confirmation of the damper during assembly, operation, and service.

In another general aspect, the rear cover sheet may have a semi-opaque surface configured to allow visual confirmation of the damper during assembly, operation, and service.

In another general aspect, the air tower assembly may include at least one air passageway with internal walls formed with a gradually increased lateral dimension starting from the freezer compartment toward the fresh food compartment.

In another general aspect, the air passageway may include at least one first air port located proximate the freezer compartment and at least one second air port located proximate the fresh food compartment.

In another general aspect, the outer housing may be formed as a single, monolithic part.

In another general aspect, a refrigerator may be provided. The refrigerator may include a freezer compartment maintaining air at a temperature of zero degrees Centigrade or less and a fresh food compartment maintaining air at a temperature greater than zero degrees Centigrade. An opening may be provided between the freezer compartment and the fresh food compartment. The opening may be configured to allow air to flow from the fresh food compartment to the freezer compartment. The refrigerator may also include an air tower assembly with an outer housing, a duct with a damper opening, a damper configured to control a flow of air from a freezer compartment to a fresh food compartment, and at least a partially transparent rear cover sheet attached to a rear of the outer housing that contains the duct and the damper within the air tower assembly.

Other features and aspects may be apparent from the following detailed description, the drawings, and the claims.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
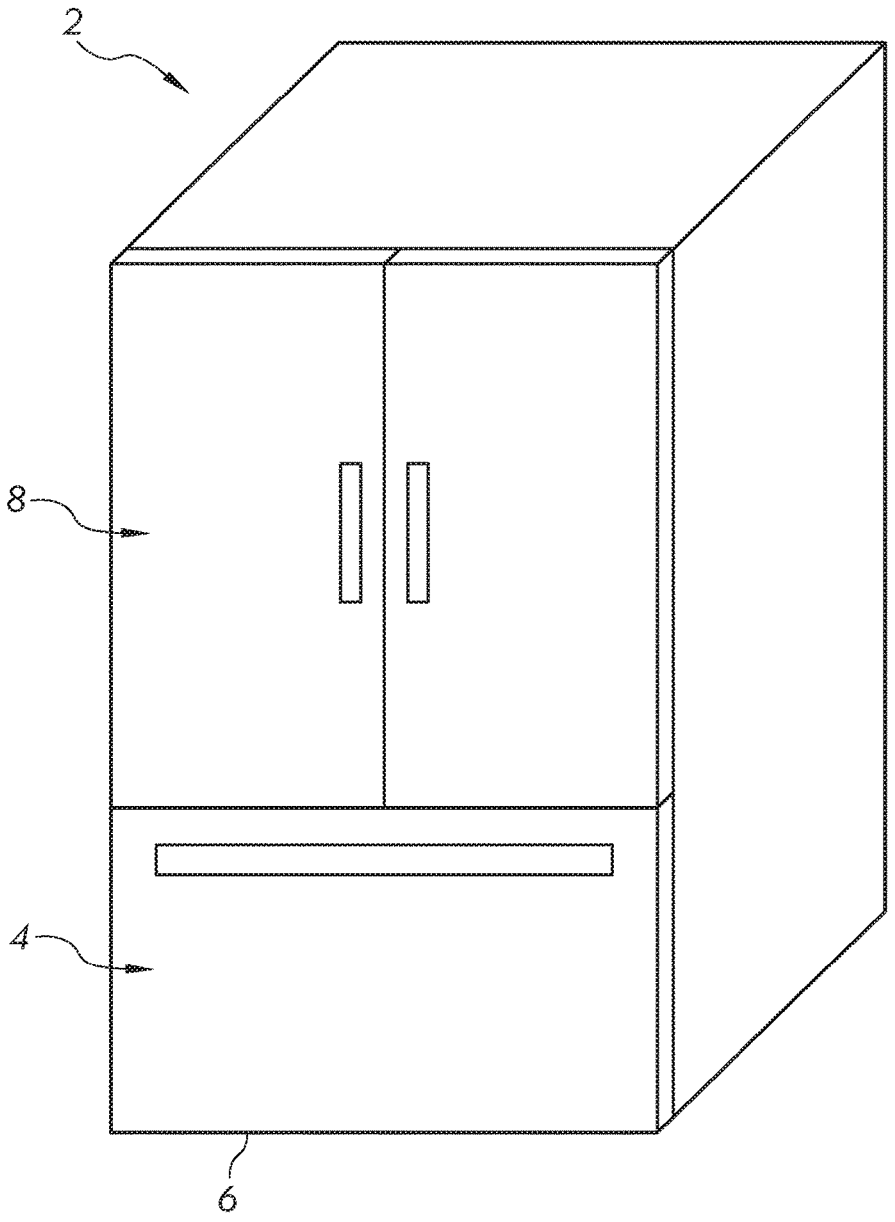
FIG. 1 illustrates a perspective view of an example refrigerator.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation.

Referring to the shown example of FIG. 1, the present application relates generally to a refrigerator 2 including a freezer compartment 4 located in the lower portion of the refrigeration appliance. The freezer compartment 4 may be accessed through a bottom mounted pull-out or pivoting freezer door 6. The freezer compartment 4 can be used to freeze and/or maintain food articles stored within in a frozen condition. The freezer compartment 4 may be maintained at an air temperature at or below zero degrees Centigrade (32° F.). In the illustrated example in FIG. 1, the upper portion of the refrigerator 2 includes a fresh food compartment 8. The fresh food compartment 8 may be used to keep food articles fresh (i.e., non-frozen) and maintain an air temperature near and above zero degrees Centigrade (32° F.).

The refrigerator 2 shown in FIG. 1 comprises one possible example of a refrigerator 2. For example, the refrigerator shown and described herein is a so-called French door bottom mount freezer assembly. A French door bottom mount freezer assembly can include a fresh food compartment 8 provided at an upper portion of the refrigerator 2 while the freezer compartment 4 is provided at a bottom portion and underneath the fresh food compartment 8. Of course, in some cases, the freezer compartment may be located above the fresh food compartment (i.e., a top mount refrigerator). In further examples, the refrigerator 2 could be provided with multiple compartments or with compartments located above and/or laterally with respect to one another. The refrigerator 2 could further include a side by side fresh food compartment and freezer compartment. In a further example, the refrigerator 2 could include either of the fresh food compartment 8 or freezer compartment 4 positioned laterally on top of the other of the fresh food compartment 8 or freezer compartment 4. In yet another example, the refrigerator 2 may include only a freezer compartment provided without a fresh food compartment, or vice-versa. Whatever arrangement of the freezer compartment 4 and the fresh food compartment 8 is employed, typically, separate access doors are provided for the refrigerated compartments so that either compartment may be accessed without exposing the other compartment to the ambient air. For example, a door provides access to the freezer compartment 4, and a separate door provides access to the fresh food compartment 8 of the refrigerator 2. Although the embodiments described in detail below, and shown in the figures are a bottom-mount configuration of a refrigerator with a fresh food compartment and a freezer compartment, the refrigerator can have any desired configuration including at least one compartment for storing food items, at least one door for closing the compartment(s), and a condenser/cooling system configured to remove heat energy from the compartment(s) to the outside environment, without departing from the scope of the present invention. Accordingly, it is to be appreciated that the refrigerator 2 shown in FIG. 1 comprises only one possible example, as any number of designs and configurations are contemplated.

Turning to the shown example of FIG. 1, the refrigerator 2 includes a fresh food compartment 8. The fresh food compartment 8 defines a substantially hollow interior portion and may include shelves, drawers, or the like. The fresh food compartment 8 can include a pair of doors, such as French doors. It is to be appreciated, however, that the fresh food compartment 8 could include other door assemblies, and is not limited to having the French doors shown in FIG. 1. Rather, in further examples, the fresh food compartment 8 could include a single door, or the like. It is to be appreciated that the fresh food compartment 8 shown in FIG. 1 is somewhat generically depicted, as the fresh food compartment 8 can include any number of shelves, drawers, bins, etc.

The refrigerator 2 further includes a freezer compartment 4. The freezer compartment 4 defines a substantially hollow interior portion and may include shelves, drawers, or the like. The freezer compartment 4 can include a door 6 (i.e., front facing side) being opened to receive a freezer door. The freezer door 6 is movable between an opened orientation or a closed orientation (as shown) in which the freezer door limits ingress and egress of air into and out of the freezer compartment 4. As such, when the freezer compartment 4 is in the closed orientation, the freezer door 6 blocks the opening of the freezer compartment 4 from the passage of air.

Figure 2:
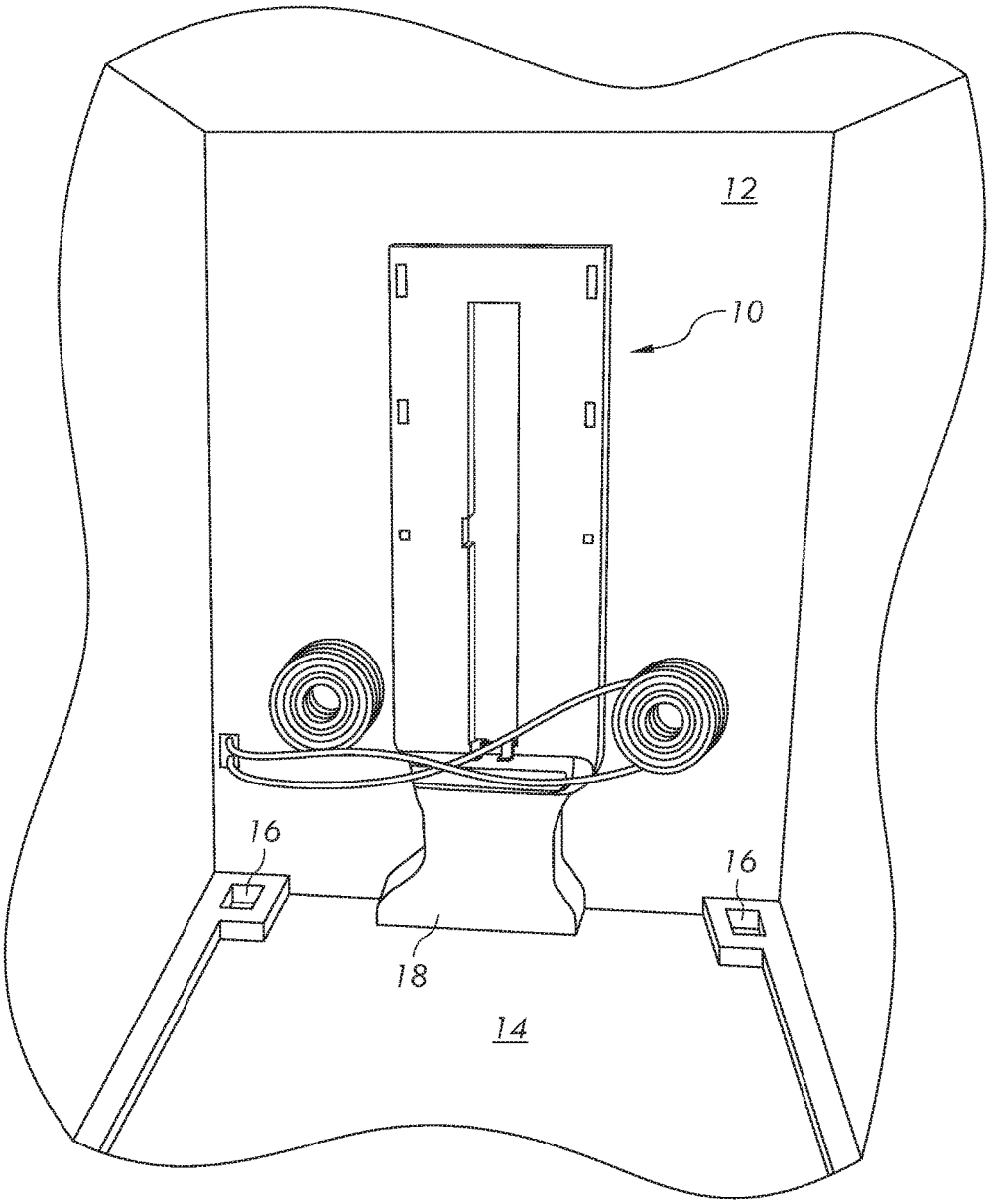
FIG. 2 illustrates a front view of an example air tower mounted in a fresh food compartment of a refrigerator.

The example of FIG. 2 shows the interior of the fresh food compartment 8 of the refrigerator 2. The interior includes an air tower 10 secured to the back of the fresh food compartment 8 to the rear wall of a liner 12. The interior is shown with tubing comprising a water tank. This tubing may be concealed by a mounting structure, such as a shelf, drawer, etc. and may be used to provide water to a water dispenser, ice dispenser, etc. The bottom of the fresh food compartment 8 comprises a floor 14, which is a portion of the wall or mullion that separates the fresh food compartment from the lower freezer compartment. The floor 14 may also include inlet openings 16 that may serve as air ducts that direct return air from the fresh food compartment to the freezer compartment below. Air that has circulated through the fresh food compartment may return to the freezer through the inlet openings 16. The floor 14 may also include an exhaust opening 18. The exhaust opening 18 serves as an air duct in the floor through which cold air (i.e., supply air) from the freezer compartment is directed to the fresh food compartment.

The floor 14 of the fresh food compartment may be recessed in the center. Liquid spills from the fresh food compartment may occur, originating from spillage of items, condensation buildup, etc. and may lead to liquid buildup. The floor 14 may be recessed to accommodate for this liquid buildup. In one embodiment, the floor 14 may be recessed only in the center with raised margins at the sides, the front, and the rear wall of the fresh food compartment floor. Furthermore, the recessed portion of the floor 14 may be lower than the inlet openings 16 and the exhaust opening 18. The recess serves to confine any liquid that is on the floor and may be designed to have varying volumetric capacities, such as holding one gallon of liquid. Having the center of the floor 14 recessed minimizes the likelihood that any of the liquid would spill over and enter either of the openings 16, 18. Similarly, the recessed center of the floor 14 reduces the chances of pooled liquid dripping from the front of the refrigerator compartment.

Figure 3:
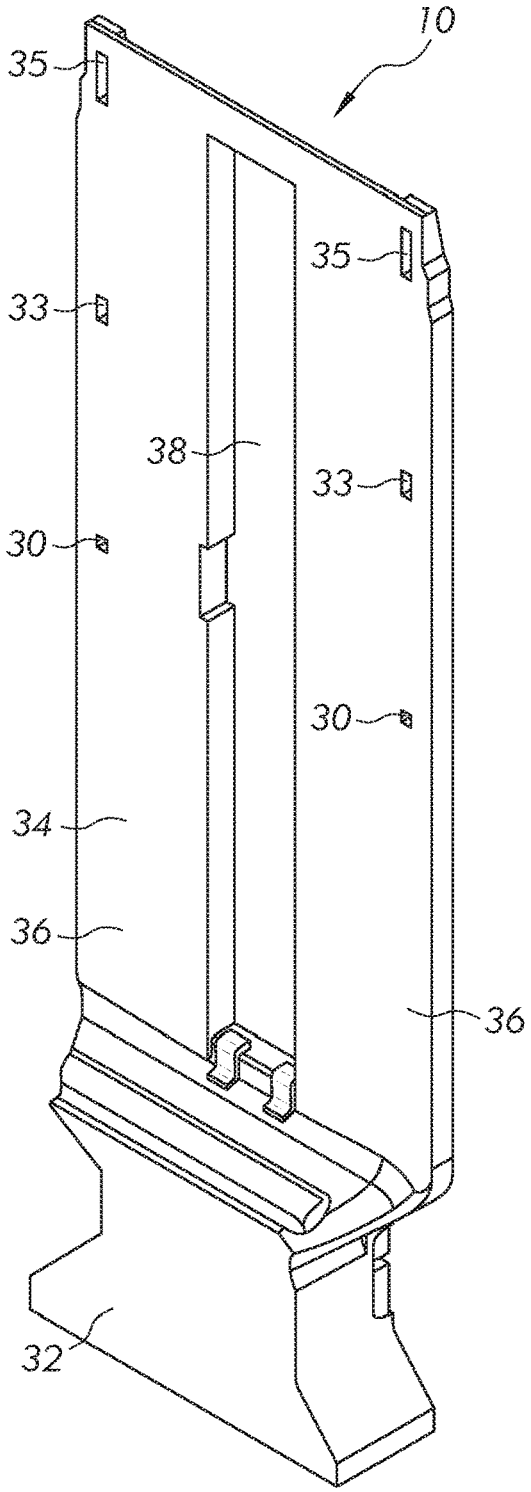
FIG. 3 illustrates a front perspective view of the example air tower of FIG. 2, according to an embodiment.
Figure 9:
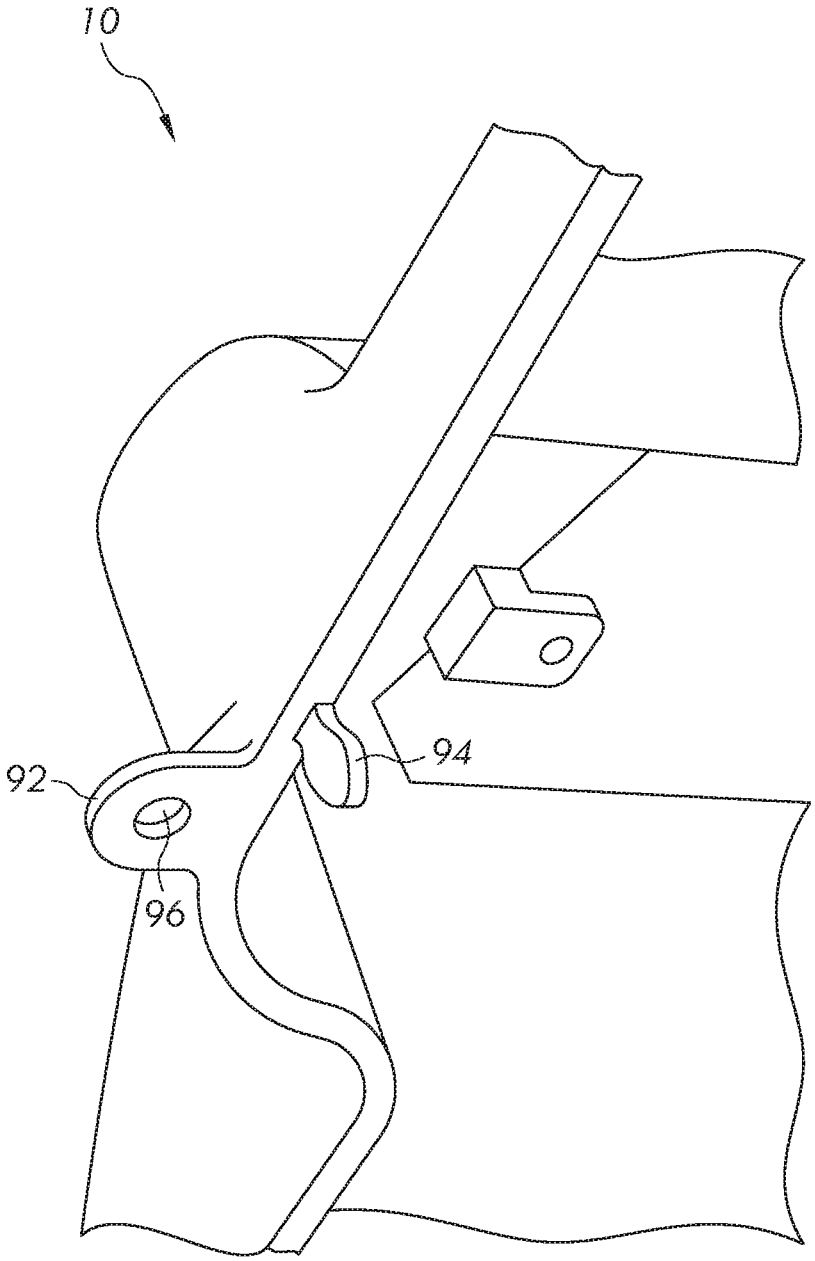
FIG. 9 illustrates a rear view of an example mounting structure of the various air towers.

FIG. 3 is a perspective view of an example air tower 10, according to an embodiment, as viewed from the front (i.e., from inside the fresh food compartment). The air tower 10 can be secured to the liner 12 by appropriate attachment structure, which may include fasteners, screws, etc. which will be discussed later with reference to FIG. 9. The air tower 10 is open at the back and mounted to the rear wall of the liner 12 such that the rear wall of the liner 12 closes off the back of the air tower 10 so as to form a plenum duct through which air may pass. Consequently, air passing through the air tower 10 will be bounded at the back by a cover (shown in FIG. 10 and described below) of the air tower 10 and bounded at the front by the air tower 10. The air tower 10 includes an upper portion 34 that may be divided into two separated air passageways 36. Each air passageway 36 is in air flow communication with a lower portion 32 of the air tower 10. The air tower 10 may optionally include an open space 38 that lies between the separated passageways 36. A mounting structure, such as a bracket, ladder etc. (not shown) may be inserted and secured to the open space 38, and/or alternatively other structure can be provided, such as air filters or lighting. The liner 12 may further include holes, as shown in FIG. 9 below, to support a mounting structure, such as a shelf, drawer, etc. that may be mounted centrally to the real wall of the liner 12. Thus, the air tower 10 will not interfere with the installation of shelves within the fresh food compartment.

The upper portion 34 of the air tower 10 may be provided with air openings, such as lower air ports 30, middle air ports 33, and upper air ports 35, for example. The air ports 30, 33, and 35 allow the cool air from the freezer compartment 4 that passes upwardly through the air tower 10 to be discharged from the air passageways 36 via the air ports 30, 33, and 35, and subsequently into the interior of the fresh food compartment 8. The air ports 30, 33, and 35 may be formed on each air passageway 36, and may be positioned or oriented variously as desired to direct the cool air towards certain parts of the fresh food compartment. While FIG. 3 shows one lower air port 30, one middle air port 33, and one upper air port 35 on each air passageway 36, it is to be understood that any number of air ports 30, 33, and 35 may be provided on each air passageway 36 in various shapes and sizes. In the example shown in FIG. 3, the upper air ports 35 have larger cross-sectional dimensions than the middle air ports 33 and the lower air ports 30 to balance out the air flow distribution and provide uniform cooling in the fresh food compartment 8, since the upper air ports 35 are located furthest from the inlet at the lower portion 32 of the air tower 10. As shown, the lowermost air ports 30 have the smallest cross-sectional dimension, while the middle air ports 33 have a relatively larger cross-sectional area, and the uppermost air ports 35 have the relatively largest cross-sectional dimension. In this manner, for a given air flow rate or pressure through the air passageway 36, relatively the same amount or rate of airflow will be discharged out of the various air ports.

Figure 4:
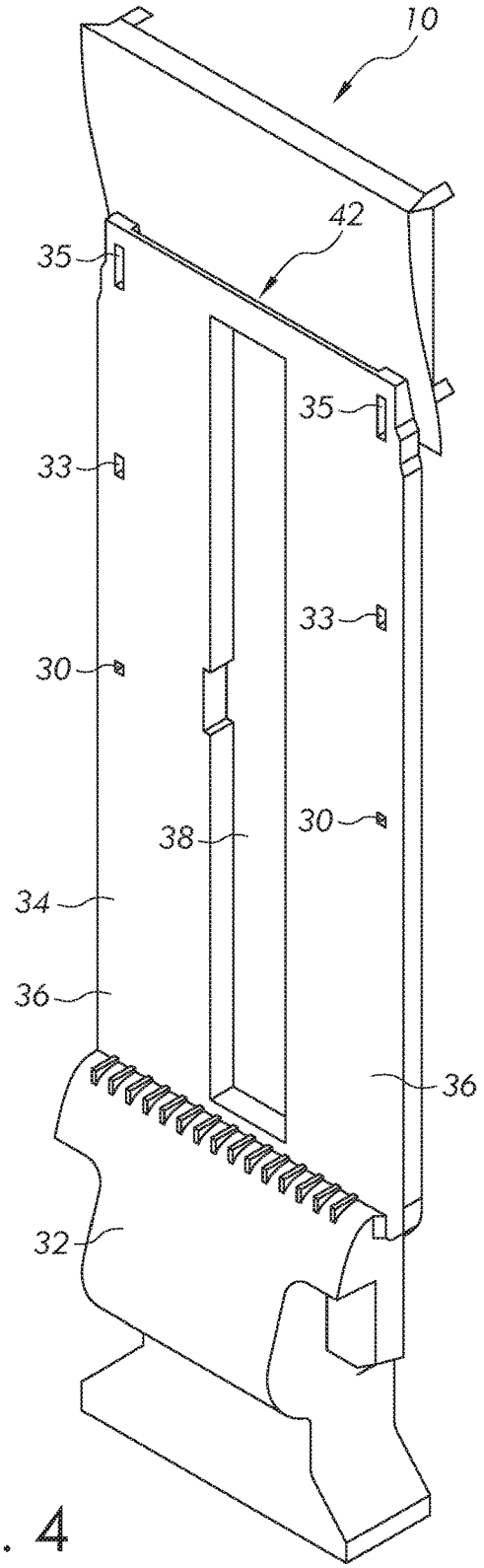
FIG. 4 illustrates a front perspective view of another example air tower, according to an embodiment.
Figure 5:
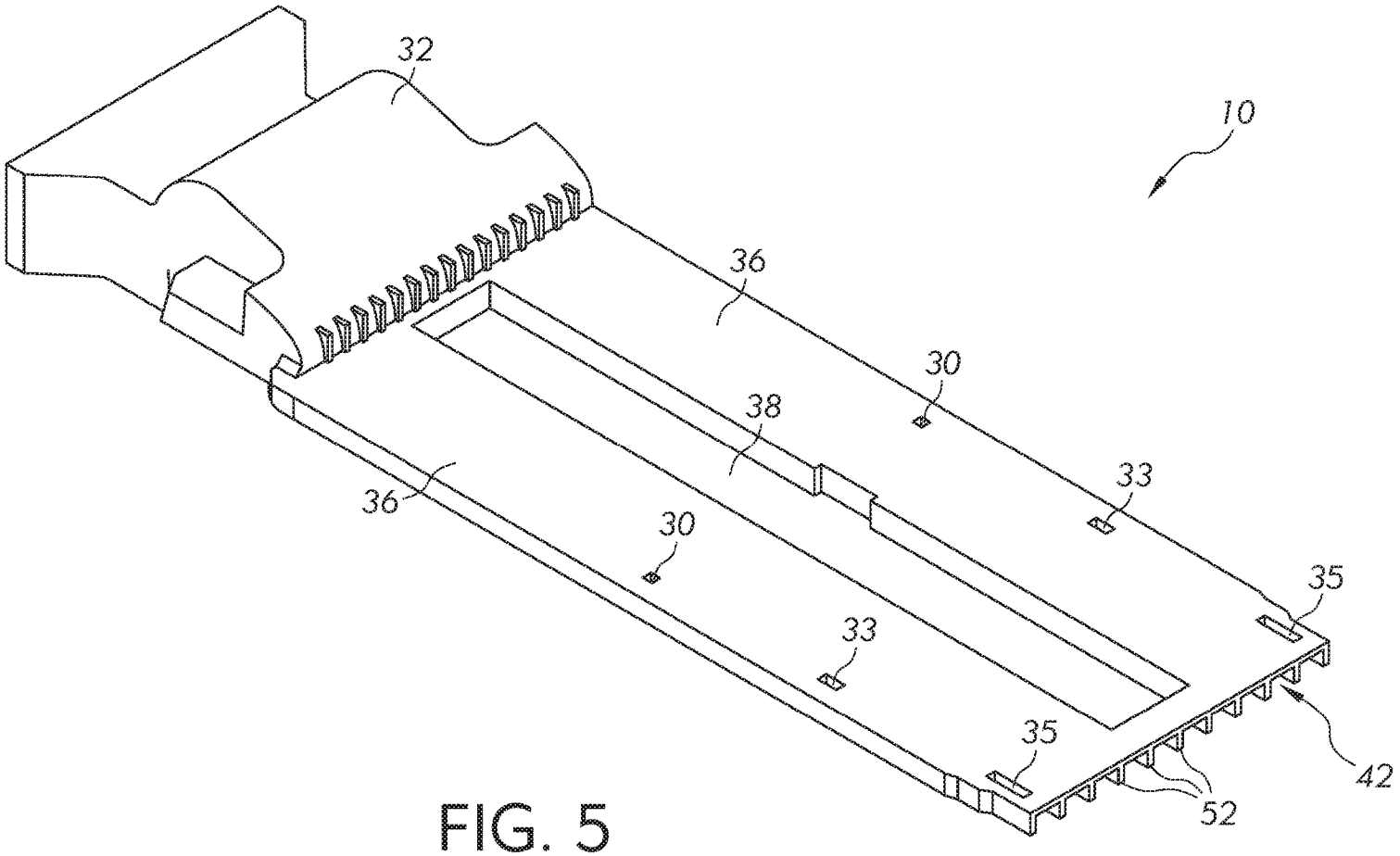
FIG. 5 illustrates a top view of the example air tower of FIG. 4, according to an embodiment.

FIG. 4 illustrates a different embodiment of the air tower 10. In the embodiment shown in FIG. 4, an aperture 42 may be formed at the top of the upper portion 34 of the air tower 10. Referring to the example shown in FIG. 5, a plurality of air-directing fins 52 may be included at the top of the air tower 10 to direct air out of the air tower that is not otherwise discharged out of the air ports 30, 33, and 35. As mentioned, the air tower and rear wall of the liner 12 form a duct through which air can pass. The air-directing fins 52 are formed at the top of the air tower 10 near the aperture 42. Air may pass through the air passageways 36, and be directed towards the aperture 42 at the top of the fresh food compartment 8. The fins 52 may be angled so as to direct and distribute air across the top of the fresh food compartment as the air exits the aperture 42. The air-directing fins 52 may be included to direct air laterally across the top of the fresh food compartment 8 and ensure that air is substantially spread across the fresh food compartment. It is to be understood, however, that the size and quantity of the air-directing fins 52 is variable, and may include more or less fins 52 than shown in the example of FIG. 5.

Figure 6:
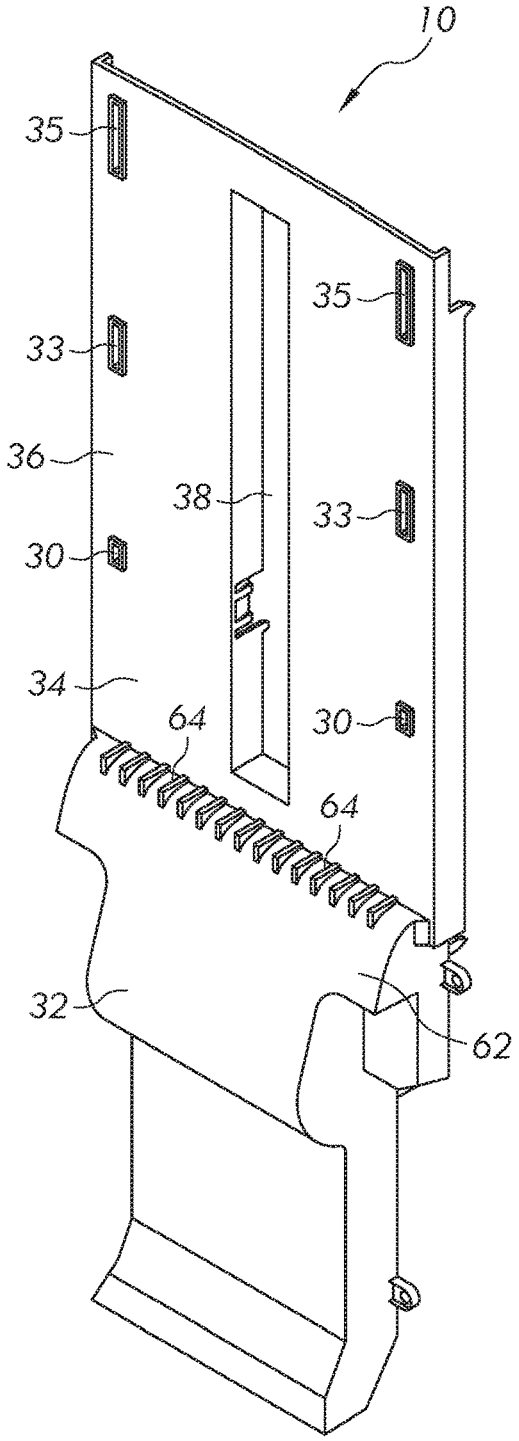
FIG. 6 illustrates a front perspective view of yet another example air tower, according to an embodiment.

As further illustrated in the example air tower shown in FIG. 6, the air tower 10 may further include a support ledge 62 having a plurality of ribs 64. The support ledge 62 may be formed at the intersection of the upper portion 34 and lower portion 32 of the air tower 10. The ribs 64 of the support ledge 62 are spaced apart from each other and may be used to create a supporting surface for the rear portion of a mounting structure, such as a drawer, shelf, etc. (not shown). By having ribs 64, air that circulates through the fresh food compartment may pass through the ribs behind the mounting structure. Thus, while providing a structural support for other components of the refrigerator, the mounting structure will not block the flow of air through the fresh food compartment.

Figure 7:
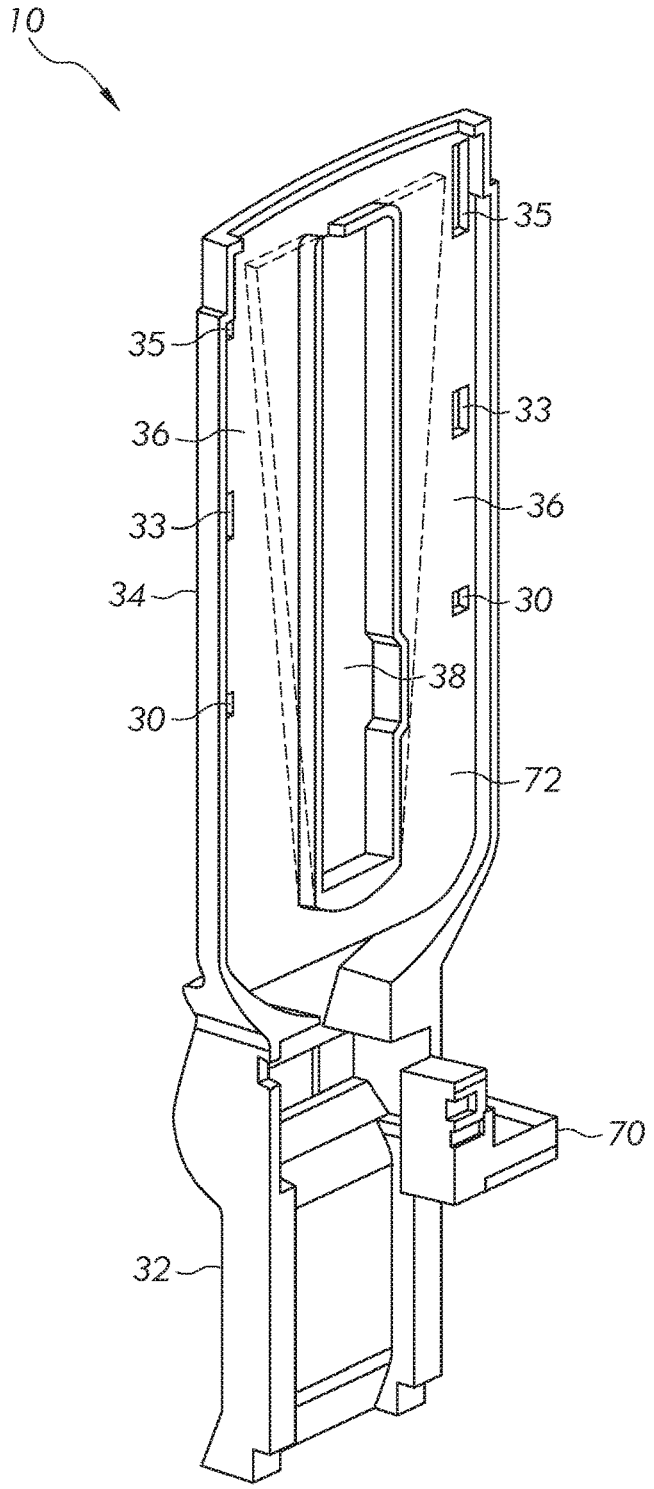
FIG. 7 illustrates a rear perspective view of the example air tower of FIG. 6, according to an embodiment.

A rear view of the lower portion 32 of the air tower 10 is shown in FIG. 7. The lower portion 32 of the air tower 10 may include one or more dampers 70 that may control the flow of air that passes through the lower portion 32 of the air tower 10 and upwards into the air passageways 36. The damper 70 may be positioned within the lower portion 32 of the air tower 10 and is designed to control the flow of air between the freezer compartment 4 and fresh food compartment 8. The damper 70 may be attached in the air duct between the freezer compartment 4 and fresh food compartment 8 such that it is bounded in the rear by a rear cover sheet (shown in FIG. 10 and discussed below) and in the front by the air tower 10. The damper 70 may be accessed for installation, service, or replacement from the rear side of the air tower 10, as will be described more fully herein (shown in FIG. 10).

Figure 8:
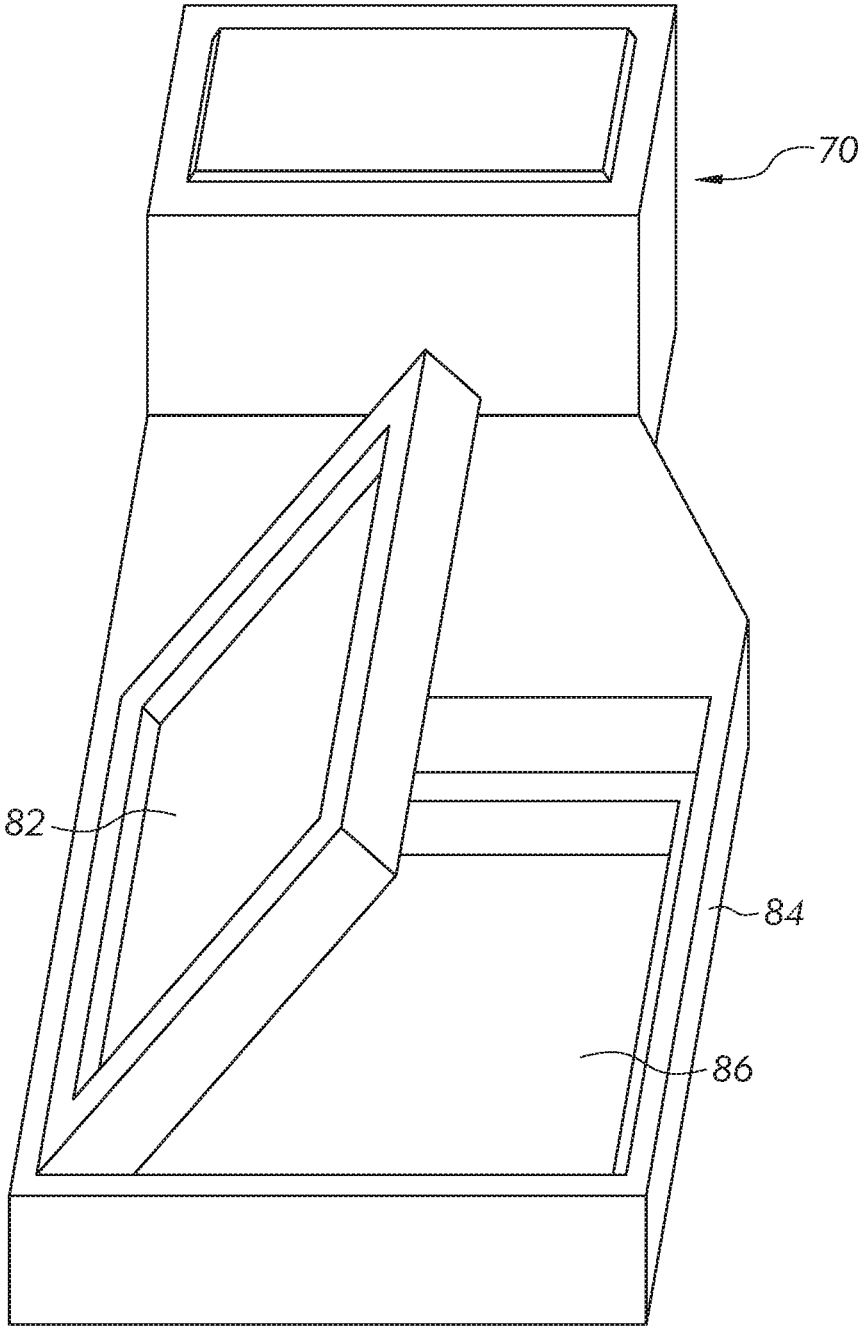
FIG. 8 illustrates a schematic perspective view of an example damper that is used within the various example air towers.

FIG. 8 shows an example of the damper 70. The damper 70 may include a damper door 82, damper door frame 84, and an opening 86 through which air may pass. When the damper door 82 is open, moisture from the fresh food compartment 8 may accumulate on the damper door frame 84. If the damper door 82 is then closed all the way to a horizontal orientation, the damper door 82 may rest on the moisture-soaked damper door frame 84 and freeze shut. To reduce the risk of freezing, the damper door 82 may form an angle from the conventional fully horizontal closed position. The angle of the fully closed position may be, for instance, 9°. The open/closed position of the damper door 82 may be controlled by a stepper motor (not shown). Therefore, the fresh food and freezer compartments may be in fluid communication even when the damper door 82 is in its fully closed position. In this embodiment, the damper door 82 may not contact the frame 84 when in a fully closed position. The stepper motor may be prompted by a user, electronic control, etc. to open and close, thus allowing more or less cold air from the freezer to pass through. For instance, if a sensor detects that the temperature in the fresh food compartment is too high, it may prompt a control to open the damper door 82 by the stepper motor. In addition or alternatively, the damper 70 may further include a defrost heater to periodically melt frost that may form on the damper door 82 or the frame 84, which could inhibit air flow or damper operation.

The example of FIG. 9 shows a view of a connection structure used to secure the air tower 10 directly to the rear interior liner 12 of the fresh food compartment 8, which may be flat, stepped, or recessed. The liner 12 may include threaded holes to receive threaded fasteners, such as screws or the like. The liner 12 may also include apertures for the insertion of snap fasteners. As shown in the embodiment of FIG. 9, the air tower 10 may include a flange 92 (also shown in FIGS. 6 and 10) and snap fasteners 94. In the example shown in FIG. 9, the flange 92 has a hole 96 in it to receive threaded fasteners, such as screws or bolts that will attach the tower 10 to the liner 12. In addition, the air tower 10 may have one or more snap fasteners 94 extending from a side of the air tower adjacent to the flange 92. To secure the air tower 10 to the liner 12, the snap fasteners 94 are inserted into open holes within the liner 12 without the use of tools such that the tower 10 does not have to be manually held in place. Once the snap fasteners 94 are secured to the liner, the flange 92 may be aligned such that the hole 96 in the flange 92 is positioned next to the threaded hole in the liner 12. A screw may then be inserted into the hole of the flange 92 and screwed into the threaded hole in the liner 12, thus securing the air tower 10 in place. It is to be appreciated that the air tower can be secured in place using only threaded fasteners, only snap fasteners, or combinations thereof. In any event, it is desirable to attach the air tower to the refrigerator liner in a manner that permits the air tower to be easily removed for service.

The air tower 10 functions by allowing cool air from the freezer compartment 4 to pass to the fresh food compartment 8. Cool air from the freezer compartment 4 enters the air tower 10 via the bottom portion 32 and passes through the damper 70. An air moving device, evaporator fan, or the like (not shown) may be utilized for providing an upward pressure to the cool air. The air moving device may be the evaporator fan located in the freezer compartment, or a primary/auxiliary fan located within the air tower. However, in the shown embodiments, the air tower 10 does not include a separate active air moving device, and instead, expels cold air received from a fan of a single freezer evaporator assembly located in the freezer compartment 4. After passing through the damper 70, the cool air, under the impetus of the air moving device, passes upwardly through the two separated passageways 36. Some of the upwardly-moving cool air may be discharged to the interior of the fresh food compartment 8 through the air ports 30, 33, 35. The remaining cool air that does not pass through the air ports 30, 33, 35 is directed by fins 52 and discharged through the aperture 42 at the top of the air tower 10. The discharged air leaves the aperture 42 and enters the upper portion of the interior of the fresh food compartment. The discharged air then descends into the interior of the fresh food compartment and cools food items located there. This arrangement ensures that items throughout the fresh food compartment, including those at the upper portion of the fresh food compartment are adequately cooled. As the discharged air descends further, it may return to the freezer compartment by passing through the inlet openings 16 at the bottom of the fresh food compartment.

Figure 10:
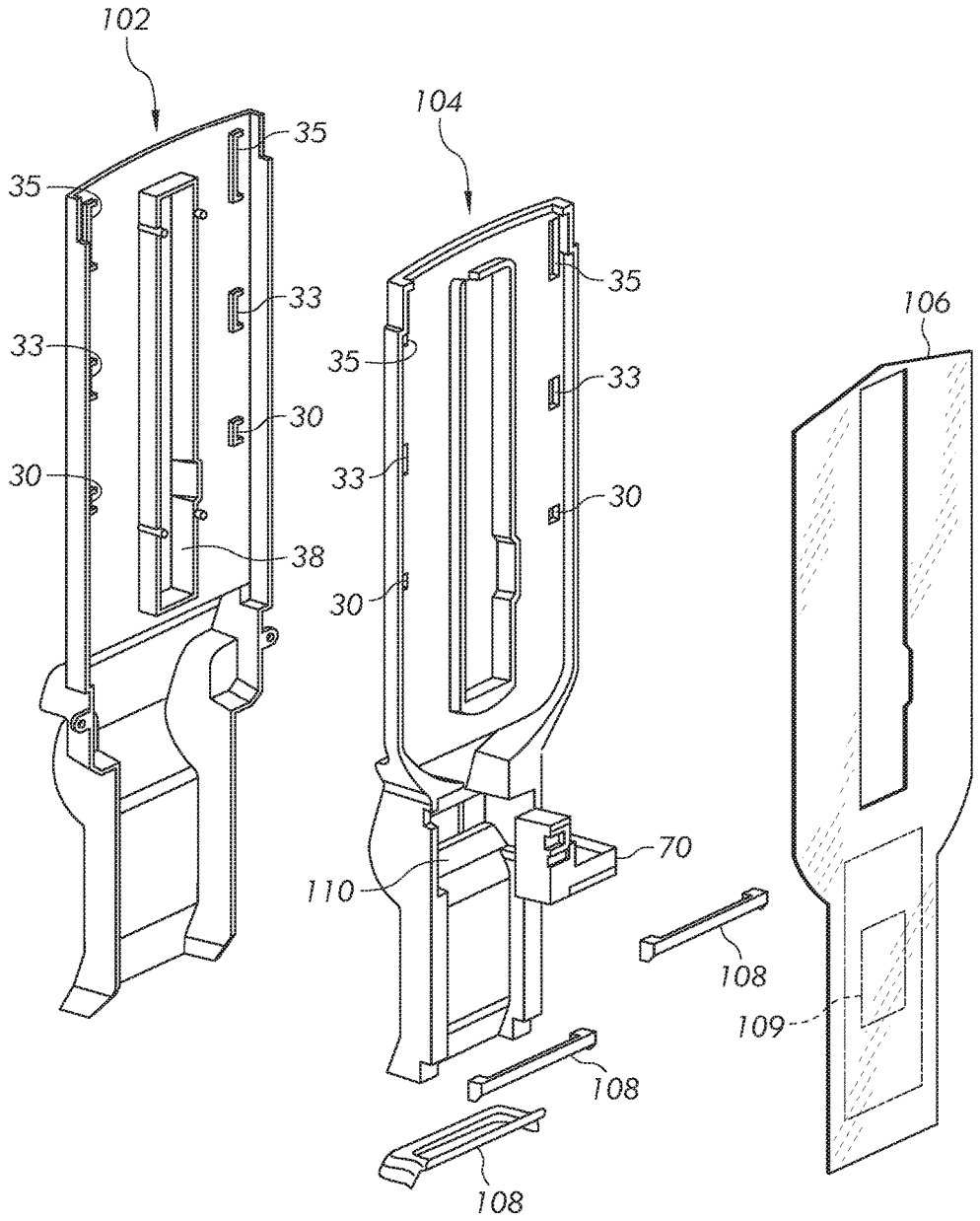
FIG. 10 illustrates a perspective exploded view of the components of the various example air towers, according to an embodiment.

FIG. 10 illustrates an exploded view of the components of an example complete air tower 10 assembly, according to an embodiment. While FIG. 10 illustrates an exploded view of the components of the air tower 10 assembly according to the embodiment illustrated in FIG. 4, different embodiments of the air tower, including but not limited to the embodiments illustrated in FIG. 3 and FIG. 6, will have similar components as the ones shown in FIG. 10. The air tower assembly 10 illustrated in FIG. 10 includes an outer housing 102, a duct or main air supply duct 104, a damper 70, and a back cover 106. The outer housing 102 protects the air duct between the freezer compartment 4 and the fresh food compartment 8. As shown in FIG. 10, the front portion of the outer housing 102 is a single, monolithic part, in which the service door (in the housing and in the duct) typically included in the conventional air towers has been eliminated to reduce air leaks. The outer housing 102 can be made of Expanded polystyrene (EPS) or other resilient plastic material (e.g., an injection molded plastic), such as a thermoplastic polymer like Acrylonitrile butadiene styrene (ABS), for example.

The duct 104 houses the damper 70 which regulates the exchange of air between the freezer compartment 4 and the fresh food compartment 8. One or more support gaskets 108 may be provided for sealing the damper 70 between the inner walls of the duct 104. An opening or pocket 110 may be formed into the duct 104 for supporting the damper 70 with a gasket trim piece, for example. The duct 104 can be made of various materials, such as plastic or insulating foam, for example. Preferably, a rigid foam is used that can define the desired airflow plenum channels while also providing insulation to keep the supply air cold before it is discharged to the fresh food compartment.

As discussed above, a gap may exist between the conventional front-access panel service door that typically covers a conventional air tower housing. The gap may increase during the life of the refrigerator due to repeated opening and closing of the access door. This gap causes an air leakage and consequently, insufficient cold air flow, making it difficult to circulate the cool air near the top, which undesirably increases the temperature in the top compartment. To eliminate air leakage and promote improved cool air circulation within the fresh food compartment, in the embodiment illustrated in FIG. 10, the front service door has been eliminated from the air tower 10 assembly. Air leaks can also be reduced by eliminating possible mismatches, wear, or malfunction of gaskets or other insulation parts that are typically placed between the access door and the duct 104.

The air tower assembly 10 can be removed from the liner 12 as a single piece. Eliminating the front-access panel service door, however, also eliminates access to the damper 70 for maintenance and repairs. Accordingly, to allow visual confirmation of the damper operation during assembly and service, the back cover 106 of the air tower assembly 10 can be made of an at least partially transparent material, which can be a clear (i.e., transparent), translucent, or semi-opaque material, such as various plastics, e.g., high-impact Polypropylene (PP), for example. As a result, the back cover 106 allows visual inspection of the damper 70 and the air plenum without further teardown of the air tower assembly 10. Preferably, all of the back cover 106 is made of a clear or translucent material, however, it is contemplated that only part of the back cover 106 may be clear or translucent. For example, only the portion of the back cover 106 near the damper 70 may be formed as a see-through window 109 to allow for visual inspection of the damper 70, while the balance of the back cover is opaque or translucent. Alternatively, the see-through window 109 may extend through the entire lower portion or through the entire portion of the back cover 106 that covers the passageways 36 to allow visual inspection of the damper 70 and the air plenum, etc.

Multiple windows 109 could be provided, which may overlap, be contiguous, adjacent, or even separate. It is further contemplated that some of the back cover 106 (such as a majority) could be translucent, while the window 109 is transparent about specific region(s), such as near the damper 70.

As illustrated in FIG. 10, the back cover 106 can be integrally molded as a single monolithic unit that covers the entire air plenum of the air tower assembly 10. Alternatively, the back cover 106 could be manufactured as separate parts that are coupled together or possibly remain separately attached to the air tower 10. In various examples, a single monolithic back cover 106 can include an integrally molded window 109; alternatively, the back cover 106 could include a recess or cut-out into which a separate translucent or transparent window 109 is removably or non-removably secured. Preferably, the back cover 106 is shaped to match the shape of the duct 104 and the outer housing 102, thereby providing insulation to keep the supply air cold inside the air tower assembly 10 before the cold air is discharged to the fresh food compartment.

The back cover 106 can be assembled to the duct 104 via any suitable connection or fasteners; e.g., back cover 106 may be snapped in place with or without the use of extrinsic fasteners. In an embodiment, the back cover 106 may be formed of a flexible or resilient plastic material (e.g., an injection molded plastic), such as a thermoplastic polymer like Acrylonitrile butadiene styrene (ABS), for example. As a result, the back cover 106 may deform against protrusions extending from the surface of the duct 104 that face the rear cover sheet, for example, expand when it is first inserted, and snap back to its resting configuration once it is firmly positioned to cover the duct 104.

To further reduce air leakage caused by the components of the air tower assembly 10, the back cover 106 may be assembled to the duct 104 and/or the outer housing 102 by various adhesives, such as a double-faced tape, for example, or even various mechanical fasteners. Various other seals may also be used. However, embodiments are not limited thereto and other solutions are possible.

An additional area causing gaps and air leakage in the conventional air tower may be a pocket created in one of the sides of the air tower housing for accommodating a thermistor. In the air tower assembly 10 shown in FIG. 10, this pocket has been eliminated. Alternative options for accommodating the thermistor may be provided in the ceiling or in the side wall of the fresh food compartment. For example, the housing for the thermistor may be foamed behind the inner liner wall, exposing only the thermistor and the inner side of the thermistor housing to the cabinet interior.

Figure 11:
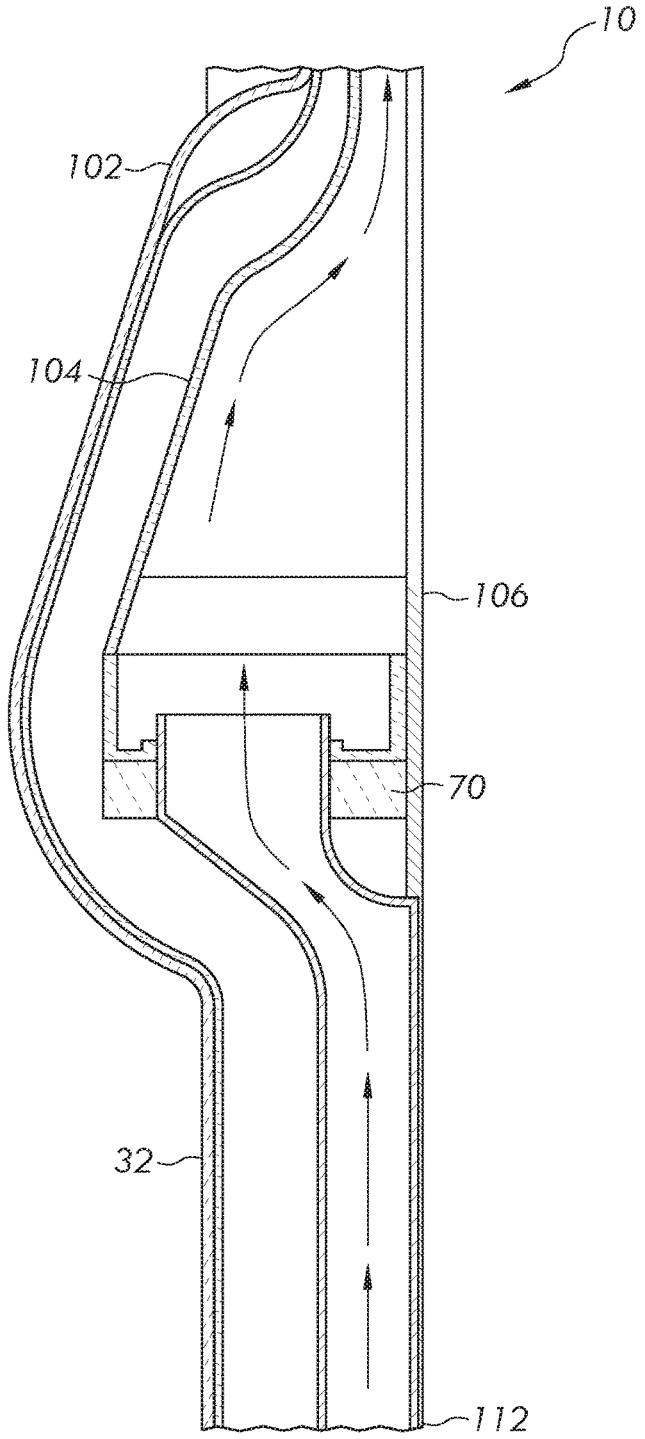
FIG. 11 illustrates a side sectional view of the example air tower of FIG. 10 that includes an example damper installed in the air tower, according to an embodiment.

FIG. 11 illustrates a side sectional view of the assembled example air tower shown in FIG. 10 and FIG. 4. As schematically shown in FIG. 11, air flows from the lower portion 32 of the air tower 10 through each of the air passageways 36 (only one air passageway 36 is shown in FIG. 11). The air passageways 36 are formed between the rear cover sheet 106 and the rear portion of the duct 104. After passing through the air passageways 36, the air may be directed towards the fresh food compartment 8.

Figure 12:
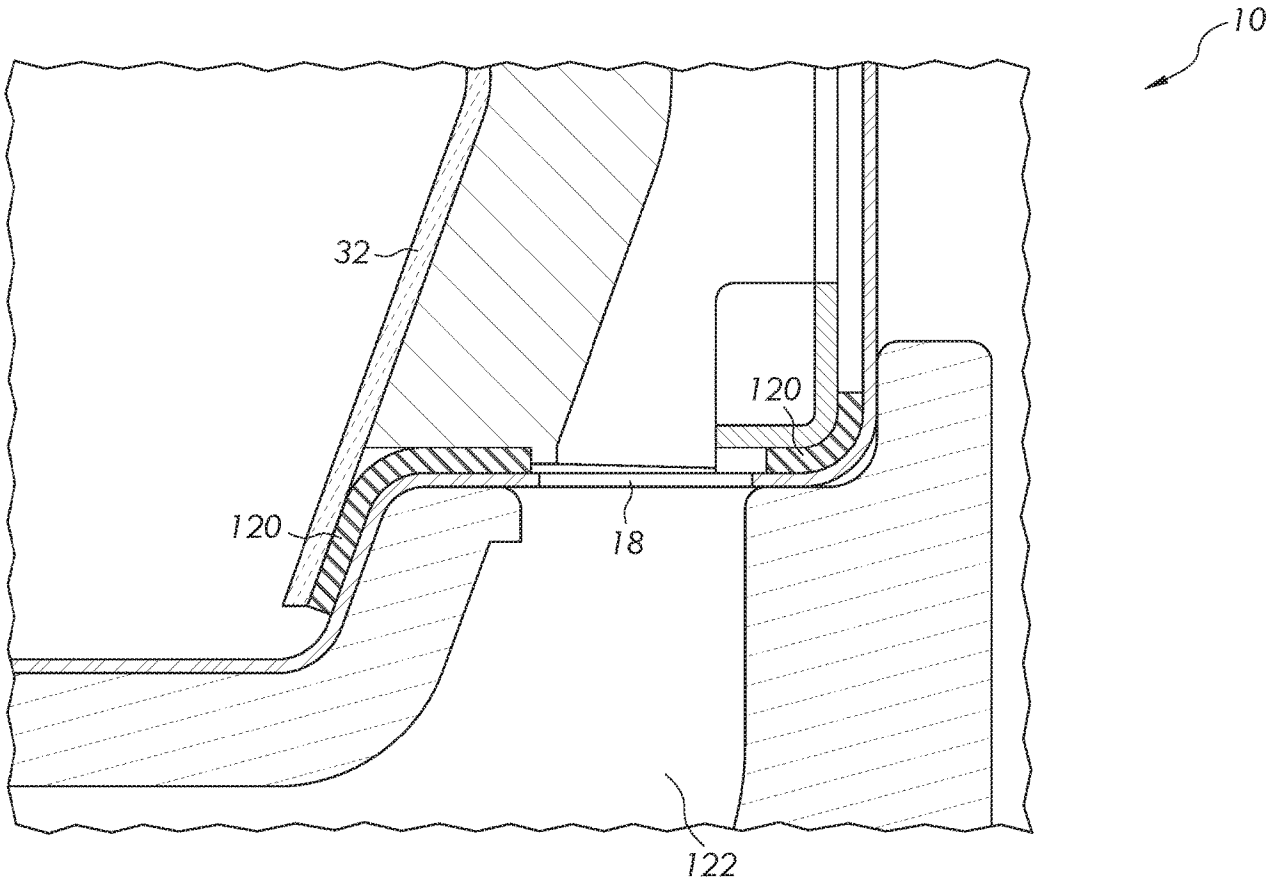
FIG. 12 illustrates a detailed, side sectional view of a lower portion of the air tower, according to an embodiment.

As further shown in FIG. 11, the damper 70 is positioned parallel to the liner base 112 (e.g., the bottom portion of the air tower 10), which results in a smoother, more laminar airflow path that increases efficiency and reduces the turbulence in the airflow. As further shown in FIG. 12, a lower gasket 120, which may be made of compressible adhesive foam, for example, is compressed to create a seal between the compartment liner 122 adjacent the exhaust opening 18 and the lower portion 32 of the air tower assembly 10.

Figure 13:
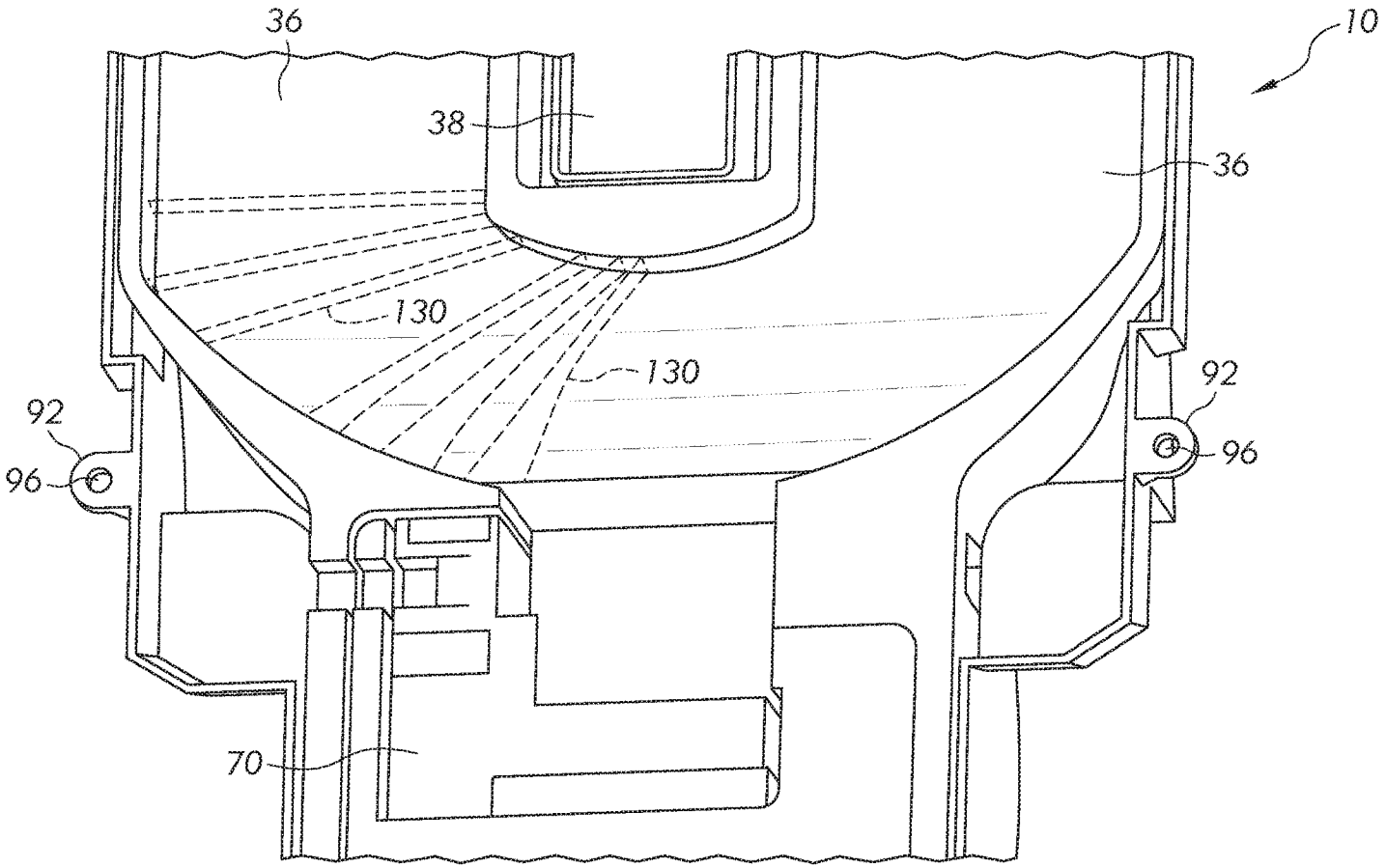
FIG. 13 illustrates a detailed, partial perspective view of an example air flow in the air tower, according to an embodiment.

Additionally, as shown in FIG. 13, the cross sectional area 130 of the air flow path has been redesigned to have a gradual decrease that increases efficiency. Specifically, the cross sectional area 130 of the air flow path extending into and through the air tower plenums (i.e., between the inlet at the lower portion 32 and the outlets at the air passageways 36) has been redesigned to gradually decrease using Computational Fluid Dynamics (CFD) software so that the overall airflow has an increased efficiency. For example, the geometry of the air flow passage 36 in the duct 104, after the damper 70, may be configured to have a more gradual volumetric reduction to improve air flow by reducing pressure drop and recirculation. Further, to maintain substantially constant air pressure through the lower air ports 30, the middle ports 33, and the upper air ports 35 formed in the outer housing 102 (best shown in FIG. 3), the inside walls of the air tower 10 (i.e., the walls of the duct 104 that form the air passageways 36) may be formed with a gradually increased lateral dimension or thickness starting from the bottom of the air tower 10 (e.g., from the freezer compartment 4) toward the fresh food compartment 8, which in turn narrows the air passageways 36 as they extend upwards and contributes to more uniform velocity of the air flow and consistency in pressure. For example, as shown schematically in FIG. 7, the inside walls 72 of the air passageways 36 can be configured to narrow as they extend upwards towards the upper air ports 35. Various configurations are contemplated whereby the cross-sectional areas of the air passageways 36 decrease from inlet to outlet.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be desirable to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. An air tower assembly for a refrigeration appliance, said air tower comprising:

an outer housing comprising at least one first air port located closer to a freezer compartment relative to at least one second air port, both of the at least one first and second air ports discharging cold air into a fresh food compartment, wherein the at least one second air port has larger cross-sectional dimensions than the at least one first air port so that relatively the same amount of airflow is discharged at a relatively same rate out of both of the first and second air ports;

a duct with a damper opening;

a damper configured to control a flow of air from a freezer compartment to a fresh food compartment; and at least a partially transparent rear cover sheet attached to a rear of the outer housing that surrounds the duct and the damper within the air tower assembly.

2. The air tower assembly according to claim 1, wherein the rear cover sheet is transparent.

3. The air tower assembly according to claim 1, wherein the rear cover sheet is integrally molded as a single monolithic unit that covers the entire duct.

4. The air tower assembly according to claim 1, wherein the rear cover sheet is configured to be inserted into snap fit protrusions extending from a surface of the duct that faces the rear cover sheet.

5. The air tower assembly according to claim 1, further comprising at least one air passageway, wherein air flows through the at least one air passageway between the rear cover sheet and a rear portion of the duct.

6. The air tower assembly according to claim 5, wherein internal walls of the at least one air passageway are formed with a gradually increased lateral dimension starting from the freezer compartment toward the fresh food compartment.

7. The air tower assembly according to claim 1, wherein the air tower is mounted directly to a liner within the fresh food compartment.

8. The air tower assembly according to claim 1, wherein the air tower assembly expels cold air received from an evaporator located in the freezer compartment.

9. The air tower assembly according to claim 1, wherein the outer housing is formed as a single, monolithic part.

10. The air tower assembly according to claim 1, wherein the damper is positioned parallel to an interior liner base.

11. The air tower assembly according to claim 1, further comprising at least one gasket compressed to create a seal between at least one of: the damper and at least one inner wall of the duct, and the damper and the rear cover sheet.

12. The air tower assembly according to claim 1, wherein the rear cover sheet comprises a clear surface configured to allow visual confirmation of the damper during assembly, operation, and service.

13. The air tower assembly according to claim 1, wherein the rear cover sheet comprises a semi-opaque surface configured to allow visual confirmation of the damper during assembly, operation, and service.

14. The air tower assembly according to claim 1, wherein the damper comprises a door and a frame of the door, said frame defining a damper opening through which the flow of the air passes.

15. The air tower assembly according to claim 14, wherein the damper door is pivotably attached directly at a side of the frame and is configured to pivot about an axis parallel to the side of the frame that the door is attached directly at with respect to the damper opening between an open position and a fully closed position.

16. The air tower assembly according to claim 15, wherein the damper door forms an angle with the frame when the door is in the open position and the fully closed position, said angle defining a range of travel of the door with respect to the damper opening, wherein a first non-zero angle corresponds to the fully closed position and a second non-zero angle corresponds to the open position.

17. The air tower assembly according to claim 16, wherein the first non-zero angle is less than the second non-zero angle, and wherein the range of travel is configured such that when in the open position and in the fully closed position a portion of the door does not contact a corresponding portion of the frame.

18. The air tower assembly according to claim 1, wherein the outer housing further comprises at least one third air port located between the at least one first air port and the at least one second air port.

19. The air tower assembly according to claim 18, wherein the at least one third air port has larger cross-sectional dimensions than the at least one first air port and wherein the at least one third air port has smaller cross-sectional dimensions than the at least one second air port.

20. A refrigeration appliance comprising:

a freezer compartment maintaining air at a temperature of zero degrees Centigrade or less;

a fresh food compartment maintaining air at a temperature of greater than zero degrees Centigrade;

an opening between the freezer compartment and the fresh food compartment, said opening being configured to allow air to flow from the freezer compartment to the fresh food compartment;

an air tower assembly disposed upon said opening, comprising:

an outer housing comprising at least one first air port located closer to the freezer compartment relative to at least one second air port, both of the at least one first and second air ports discharging cold air into the fresh food compartment, wherein the at least one second air port has larger cross-sectional dimensions than the at least one first air port so that relatively the same amount of airflow is discharged at a relatively same rate out of both of the first and second air ports;

a duct with a damper opening;

a damper configured to control a flow of air from a freezer compartment to a fresh food compartment; and at least a partially transparent rear cover sheet attached to a rear of the outer housing that surrounds the duct and the damper within the air tower assembly, wherein at least one air passageway is defined between the rear cover sheet and a rear portion of the duct, through which said air flows from the freezer compartment to the fresh food compartment.

* * * * *